US005438771A

United States Patent [19]

Sahm et al.

[11] Patent Number: 5,438,771

[45] Date of Patent: Aug. 8, 1995

[54] METHOD AND APPARATUS FOR DETERMINING THE LOCATION AND ORIENTATION OF A WORK MACHINE

[75] Inventors: W. Charles Sahm, Peoria; Adam J. Gudat, Edelstein; Daniel E. Henderson, Washington, all of Ill.

[73] Assignee: Caterpillar Inc., Peoria, Ill.

[21] Appl. No.: 241,118

[22] Filed: May 10, 1994

[51] Int. Cl.[6] ..... E02F 5/10

[52] U.S. Cl. ..... 37/348; 172/7; 364/424.07

[58] Field of Search ..... 342/25, 149, 174, 191, 342/357; 364/DIG. 1, 232.9, 230.2, 424, 458, 424.07; 37/348, 349, 103; 172/4.5, 7; 111/903, 904

[56] References Cited

U.S. PATENT DOCUMENTS

| | | | |
|---|---|---|---|
| 4,244,123 | 1/1981 | Lazure et al. | 37/348 |
| 4,630,685 | 12/1986 | Huck, Jr. et al. | 172/7 |
| 4,677,555 | 6/1987 | Goyet | 37/348 X |
| 4,776,750 | 10/1988 | Griswold, Jr. et al. | 37/348 X |
| 4,812,991 | 3/1989 | Hatch | 364/458 |
| 4,888,890 | 12/1989 | Studebaker et al. | 37/348 |
| 4,912,643 | 3/1990 | Beirxe | 37/348 X |
| 4,963,889 | 10/1990 | Hatch | 342/357 |
| 5,065,326 | 11/1991 | Sahm | 364/424.07 |

OTHER PUBLICATIONS

Article entitled "Artificial intelligence in the control and operation of construction plant–the autonomous robot excavator" published 1993.

Article entitled "Automation and Robotics in Construction"—vol. 1 by FHG ( 9 pages) belived to have been published on or about Jun., 1991.

Article entitled "Backhoe Monitor" by IHC (3 pages-)—publication date unkown but believed to be prior to one year before the filing date.

*Primary Examiner*—Dennis L. Taylor
*Assistant Examiner*—Robert Pezzuto
*Attorney, Agent, or Firm*—Steven R. Janda

[57] ABSTRACT

An apparatus is provided for determining the location of a digging implement at a work site. The apparatus includes an undercarriage, a car body rotatably connected to the undercarriage, a receiver connected to the car body, a positioning system for determining the location of the receiver in three dimensional space, the positioning system determining the location of the receiver at a plurality of points along an arc, and a processor for determining the location and orientation of the car body in response to the location of the plurality of points.

18 Claims, 12 Drawing Sheets

METHOD AND APPARATUS FOR DETERMINING THE LOCATION AND ORIENTATION OF A WORK MACHINE

TECHNICAL FIELD

The invention relates generally to control of work machines, and more particularly, to a method and apparatus for determining the location and orientation of a work machine in response to an external reference.

BACKGROUND ART

Work machines such as excavators, backhoes, front shovels, and the like are used for excavation work. These excavating machines have work implements which consist of boom, stick and bucket linkages. The boom is pivotally attached to the excavating machine at one end, and its other end is pivotally attached to a stick. The bucket is pivotally attached to the free end of the stick. Each work implement linkage is controllably actuated by at least one hydraulic cylinder for movement in a vertical plane. An operator typically manipulates the work implement to perform a sequence of distinct functions which constitute a complete excavation work cycle.

The earthmoving industry has an increasing desire to automate the work cycle of excavating machines for several reasons. Unlike a human operator, an automated excavating machine remains consistently productive regardless of environmental conditions and prolonged work hours. The automated excavating machine is ideal for applications where conditions are dangerous, unsuitable or undesirable for humans. An automated machine also enables more accurate excavation making up for any lack of operator skill.

A lot of effort has gone into developing the automatic excavation algorithms. In this development, the digging and therefore the bucket position is described relative to the excavator car body. As long as the car body sits horizontally on the ground (no tilt or pitch) the computations can be made to determine the bucket location provided that the car body location is known. As the orientation of the excavator changes additional sensors are added to determine the pitch and roll to compensate. Often a laser system is used to determine the elevation of the body and multiple detectors on the car body are used to determine orientation. Still there is no information available as to the x,y location of the excavator within the work site.

The present invention is directed to overcoming one or more of the problems set forth above.

DISCLOSURE OF THE INVENTION

The disclosed invention provides x,y, and z location and roll and pitch information for a work machine from a single sensor.

In one aspect of the invention, an apparatus is provided for determining the location of a digging implement at a work site. The apparatus includes an undercarriage, a car body rotatably connected to the undercarriage, a receiver connected to the car body, a positioning system for determining the location of the receiver in three dimensional space, the positioning system determining the location of the receiver at a plurality of points along an arc, and a processor for determining the location and orientation of the car body in response to the location of the plurality of points.

In a second aspect of the invention, a method for determining the location of a work machine at a work site, the work machine including an undercarriage and a car body rotatably connected to the undercarriage. The method including the steps of rotating the car body, receiving signals from an external reference source, determining the location of a receiver in three dimensional space as the car body rotates whereby the location of the receiver is determined at a plurality of points, and determining the location and orientation of the car body in response to the location of the plurality of points.

The invention also includes other features and advantages that will become apparent from a more detailed study of the drawings and specification.

BRIEF DESCRIPTION OF THE DRAWINGS

For a better understanding of the invention, reference may be made to the accompanying drawings, in which.

BEST MODE FOR CARRYING OUT THE INVENTION

Figure 1:
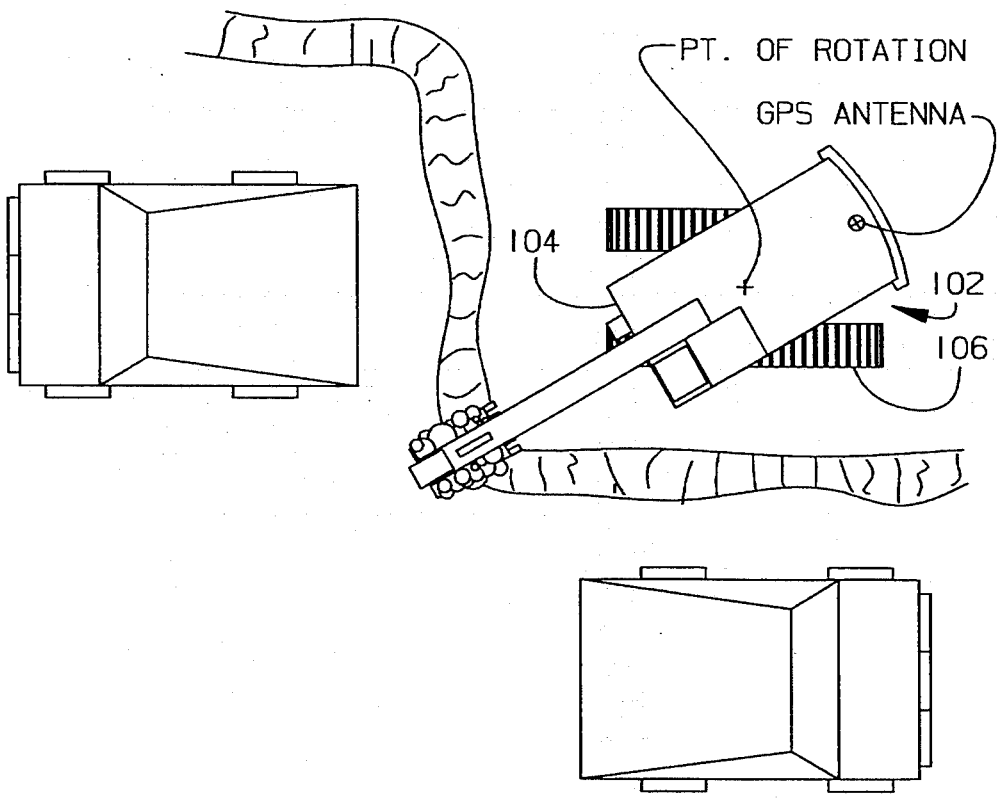
FIG. 1 is a diagrammatic illustration of a hydraulic excavator operating in a work site.
Figure 2:
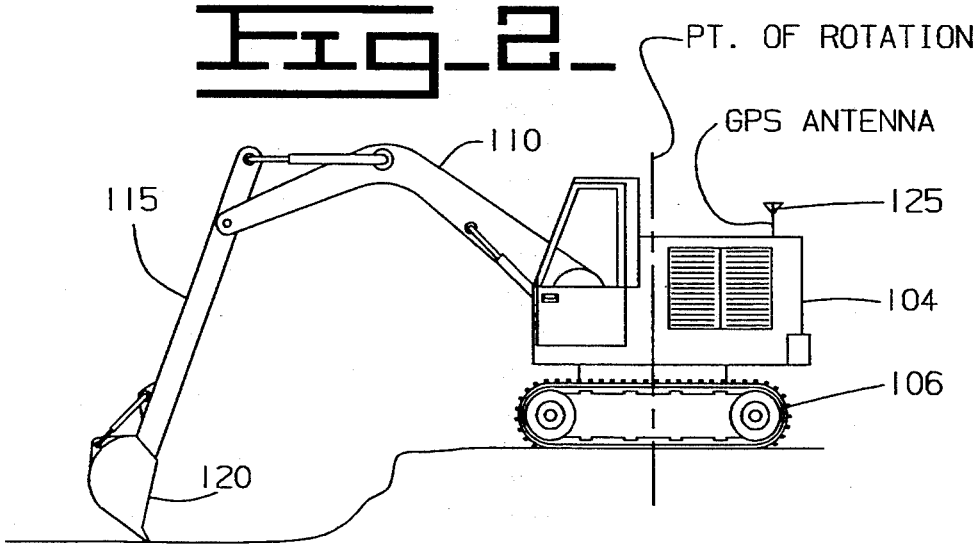
FIG. 2 is a diagrammatic illustration of a hydraulic excavator operating in a work site.
Figure 3:
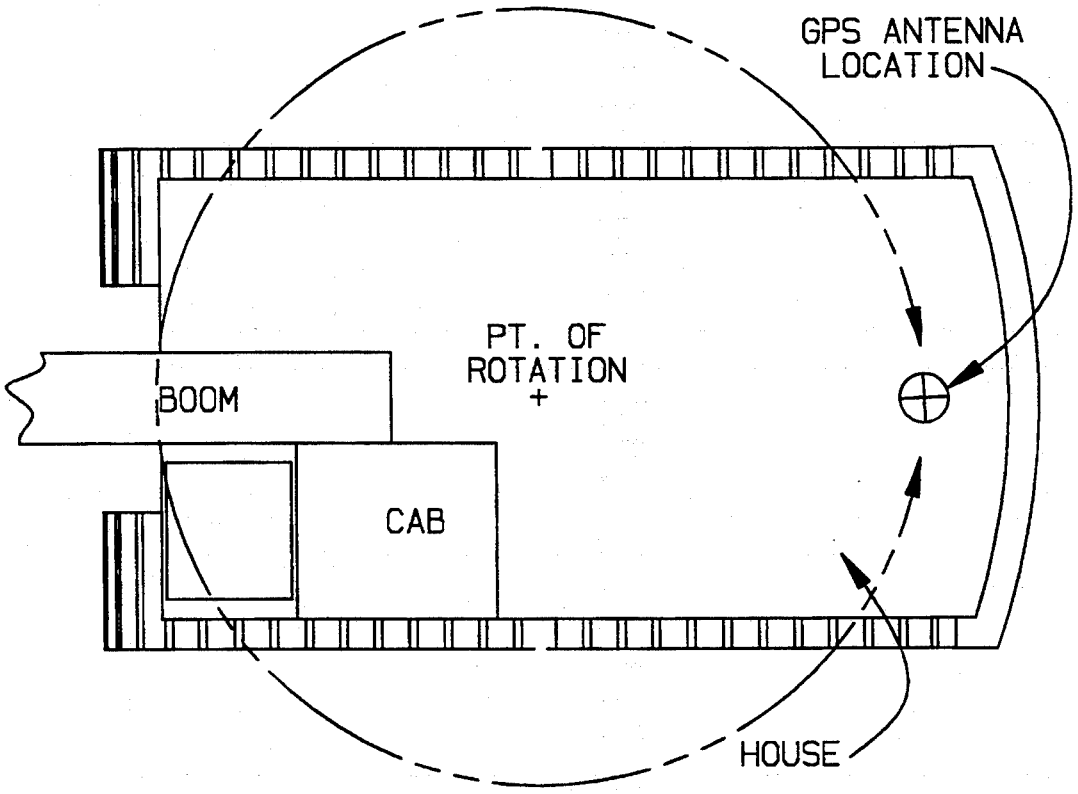
FIG. 3 is a schematic top view of a hydraulic excavator.

A work machine is illustrated in FIGS. 1, 2, and 3 and may include an excavator, power shovel, or the like. The work machine 102 includes a rotatable car body 104 connected to an undercarriage 106. The work machine 102 may also include a boom 110, stick 115, and bucket 120. The boom 110 is pivotally mounted on the excavating machine 105 by a boom pivot pin. The stick 115 is pivotally connected to the free end of the boom 110 at a stick pivot pin. The bucket 120 is pivotally attached to the stick 115 at a bucket pivot pin.

As shown in FIGS. 2 and 3, a receiver 125 is connected to the car body 104. The receiver is advantageously displaced from and rotates about the axis of rotation of the car body 104 as the car body 104 swings with respect to the undercarriage 106. In the preferred embodiment, the receiver 125 is part of a known three-dimensional positioning system with an external reference, for example (but not limited to) 3-D laser, GPS, GPS/laser combinations, radio triangulation, microwave, or radar. While the receiver 125 is shown mounted to the rear of the car body 104 opposite the implement linkage, it should be apparent that other locations are equally possible, such as on top of the operator compartment.

Figure 4:
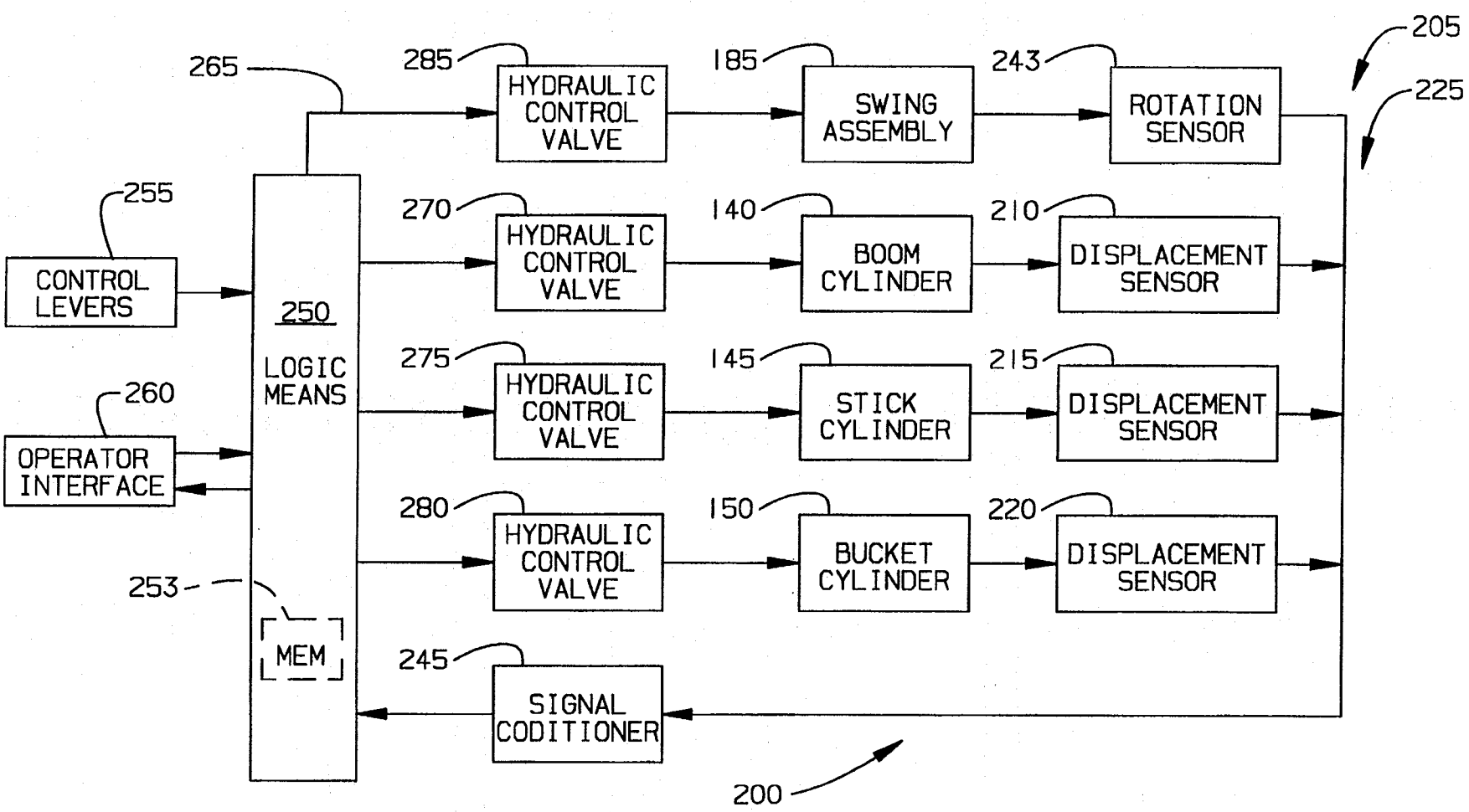
FIG. 4 is a block diagram of a machine control.

Referring now to FIG.4, a block diagram of an electrohydraulic system 200 associated with the work machine 102 is shown. A means 205 produces position signals in response to the position of the work implement 100. The means 205 includes displacement sensors 210,215,220 that sense the amount of cylinder extension in the boom, stick and bucket hydraulic cylinders, respectively. A radio frequency based sensor described in U.S. Pat. No. 4,737,705 issued to Bitar et al. on April 12, 1988 may be used.

The bucket position is also derivable from the work implement joint angle measurements. An alternative device for producing a work implement position signal includes rotational angle sensors such as rotatory potentiometers, for example, which measure the angles between the boom 110, stick 115 and bucket 120. The work implement position may be computed from either the hydraulic cylinder extension measurements or the joint angle measurement by trigonometric methods. Such techniques for determining bucket position are well known in the art and may be found fin, for example, U.S. Pat. No. 3,997,071 issued to Teach on Dec. 14, 1976 and U.S. Pat. No. 4,377,043 issued to Inui et al. on Mar. 22, 1983.

A swing angle sensor 243, such as a rotary potentiometer, located at the work implement pivot point, produces an angle measurement corresponding to the amount of work implement rotation about the swing axis.

The position signals are delivered to a signal conditioner 245. The signal conditioner 245 provides conventional signal excitation and filtering. A Vishay Signal Conditioning Amplifier 2300 System manufactured by Measurements Group, Inc. of Raleigh, N.C. may be used for such purposes, for example. The conditioned position signals are delivered to a logic means 250. The logic means 250 is a microprocessor based system which utilizes arithmetic units to control processes according to software programs. Typically, the programs are stored in read-only memory, random-access memory or the like. The programs are discussed in relation to various flowcharts described below.

The logic means 250 includes inputs from two other sources: multiple joystick control levers 255 and an operator interface 260. The control lever 255 provides for manual control of the work implement. The output of the control lever 255 determines the bucket movement direction and velocity.

The interface 260 device may include a liquid crystal display screen with an alphanumeric key pad. A touch sensitive screen implementation is also suitable. Further, the operator interface 260 may also include a plurality of dials and/or switches for the operator to make various excavating condition settings.

Figure 5:
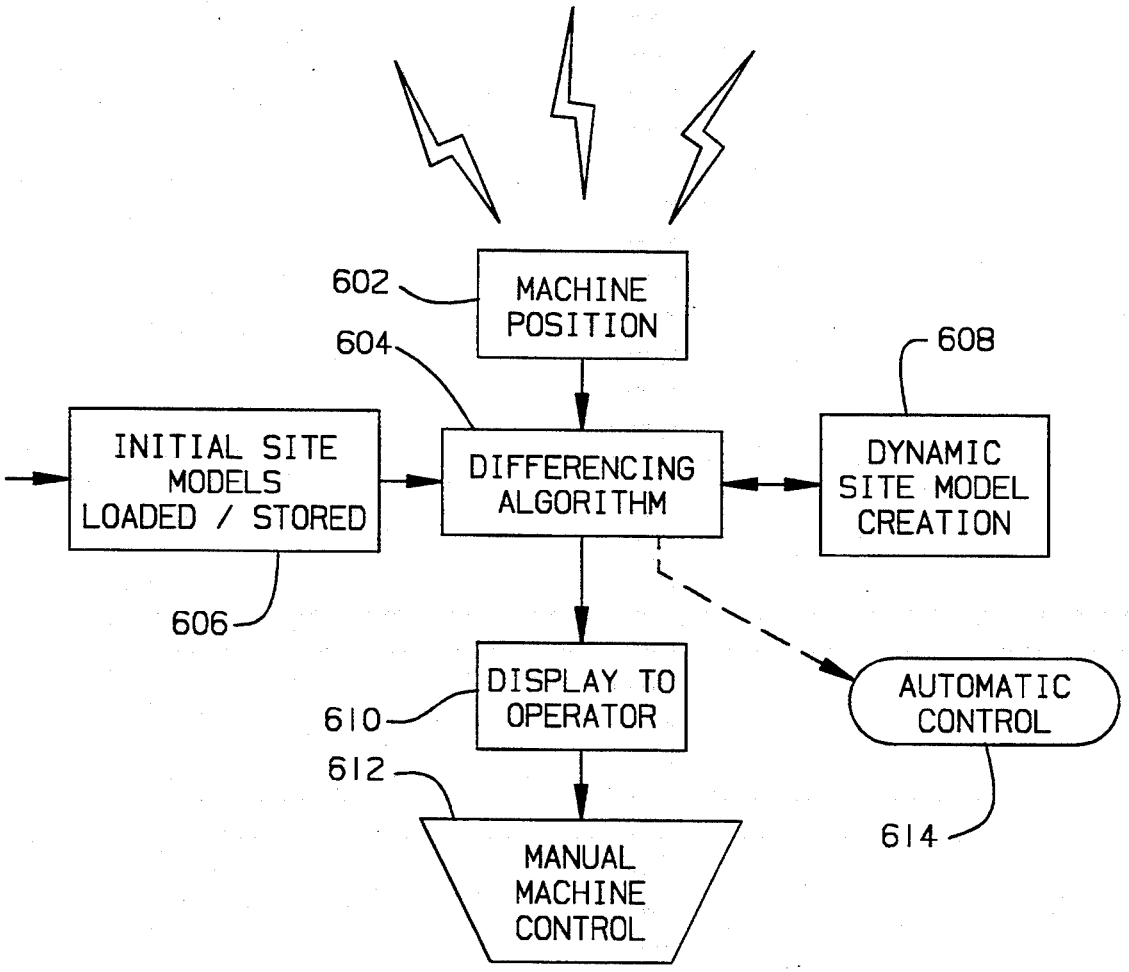
FIG. 5 is a block diagram describing the interrelated system.

Turning now to FIG. 5, the method of the present invention is shown schematically. Using a known three-dimensional positioning system with an external reference, for example (but not limited to) 3-D laser, GPS, GPS/laser combinations, radio triangulation, microwave, or radar, receiver position coordinates are determined in block 602 as the machine operates within the work site. These coordinates are instantaneously supplied as a series of discrete points to a differencing algorithm at 604. The location and orientation information is then made available to the operator in display step 610, providing real time position indications of the work machine 102 in a presurveyed work site in human readable form. Using the information from the display the operator can efficiently monitor and direct the manual control of the machine at 612.

Additionally, or alternately, the dynamic update information can be provided to an automatic machine control system at 614. The controls can provide an operator assist to minimize machine work and limit the manual controls if the operator's proposed action would, for example, overload the machine. Alternately, the site update information from the dynamic database can be used to provide fully automatic machine/tool control.

Figure 6:
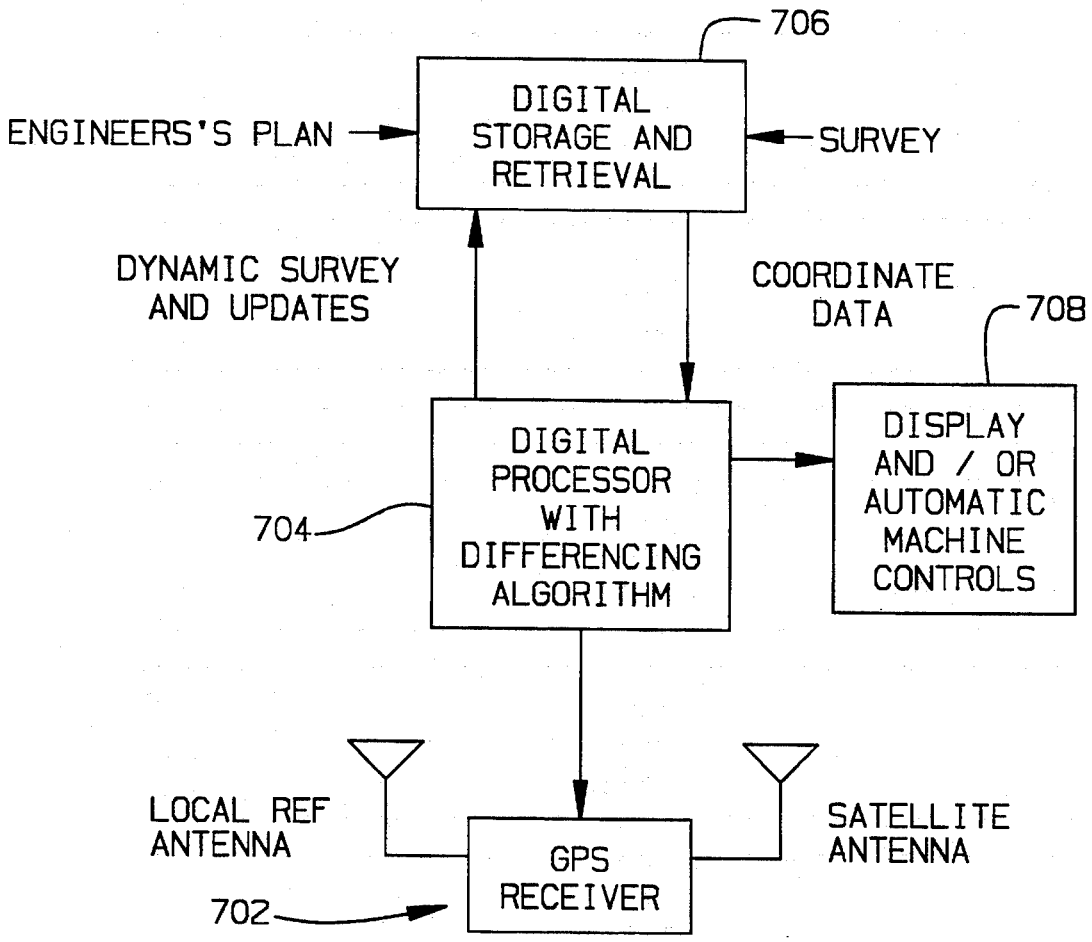
FIG. 6 is a block diagram describing the interrelated system.

Referring now to FIG. 6, an apparatus which can be used in connection with the receipt and processing of GPS signals to carry out the present invention is shown in block diagram form comprising a GPS receiver apparatus 702 with a local reference antenna and a satellite antenna; a digital processor 704 employing a differencing algorithm, and connected to receive position signals from 702; a digital storage and retrieval facility 706 accessed and updated by processor 704, and an operator display and/or automatic machine controls at 708 receiving signals from processor 704.

GPS receiver system 702 includes a satellite antenna receiving signals from global positioning satellites, and a local reference antenna. The GPS receiver system 702 uses position signals from the satellite antenna and differential correction signals from the local reference antenna to generate position coordinate data in three-dimensions to centimeter accuracy for moving objects. Alternatively, raw data from the reference antenna can be processed by the system to determine the position coordinate data.

This position information is supplied to digital processor 704 on a real-time basis as the coordinate sampling rate of the GPS receiver 702 permits. The digital storage facility 706 stores a site model of the work site. The machine position and site model are provided to the operator display and/or automatic machine controls at 708 to direct the operation of the machine over the site.

Figure 7:
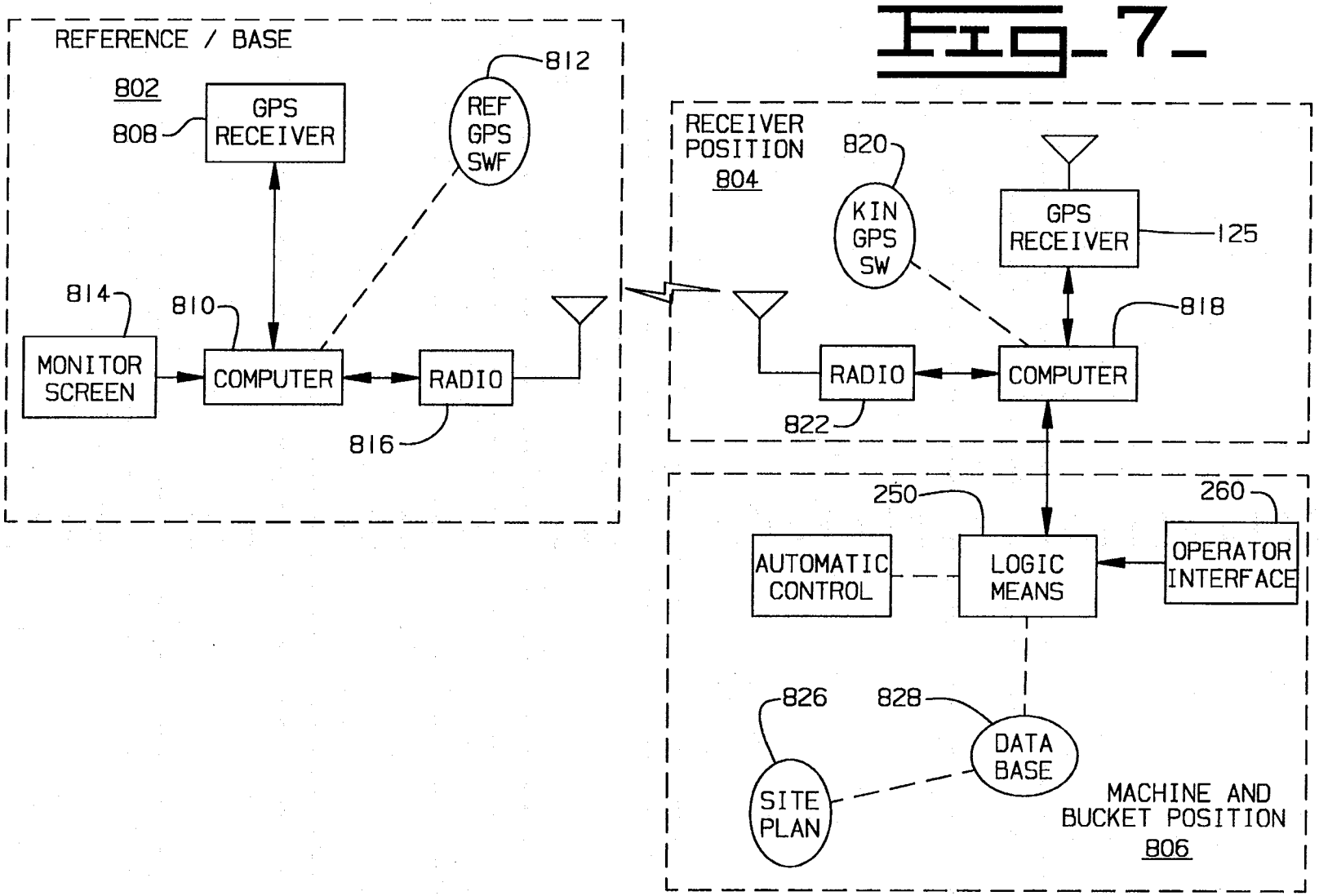
FIG. 7 is a block diagram describing the interrelated system.

Referring now to FIG. 7, a more detailed schematic of a system according to FIG. 6 is shown using kinematic GPS for position reference signals. A base reference module 802 and a position module 804 together determine the three-dimensional coordinates of the receiver 125 relative to the site, while an machine and bucket position module 806 converts this position information into real time representations of the machine, bucket, and work site which can be used to accurately monitor and control the machine.

Base reference module 802 includes a stationary GPS receiver 808; a computer 810 receiving input from receiver 808; reference receiver GPS software 812, temporarily or permanently stored in the computer 810; a standard computer monitor screen 814; and a digital transceiver-type radio 816 connected to the computer and capable of transmitting a digital data stream. In the illustrative embodiment base reference receiver 808 is a high accuracy kinematic GPS receiver; computer 810 for example is a 486DX computer with a hard drive, 8 megabyte RAM, two serial communication ports, a printer port, an external monitor port, and an external keyboard port; monitor screen 814 is a passive matrix color LCD or any other suitable display type, such as VGA; and radio 816 is a commercially available digital data transceiver.

Position module 804 comprises a matching kinematic GPS receiver 202, a matching computer 818 receiving input from receiver 202, kinematic GPS software 820 stored permanently or temporarily in computer 818, and a matching transceiver-type digital radio 822 which receives signals from radio 816 in base reference module 802. In the illustrative embodiment position module 804 is located on the mining shovel to move with it over the work site.

Machine and bucket machine and bucket position module 806, also carried on board the machine in the illustrated embodiment, includes an additional logic means 250, receiving input from position module 804; one or more digitized site models 826 digitally stored or loaded into the computer memory; a dynamic database update module 828, also stored or loaded into the memory of logic means 250; and an operator interface 260 including a color display screen connected to the logic means 250. Instead of, or in addition to, operator interface 260, an automatic machine controls can be connected to the computer to receive signals which operate the machine in an autonomous or semi-autonomous manner. To provide further information regarding operation of the work machine 102 to the logic means 250, the sensors and inputs illustrated in FIG. 4 are also connected to the logic means 250.

Although machine and bucket position module 806 is here shown mounted on the mobile machine, some or all portions may be stationed remotely. For example, logic means 250, site model(s) 826, and dynamic database 828 could be connected by radio data link to position module 804 and operator interface 260. Position and site update information can then be broadcast to and from the machine for display or use by operators or supervisors both on and off the machine.

Base reference station 802 is fixed at a point of known three-dimensional coordinates relative to the work site. Through receiver 808 base reference station 802 receives position information from a GPS satellite constellation, using the reference GPS software 812 to derive an instantaneous error quantity or correction factor in known manner. This correction factor is broadcast from base station 802 to position station 804 on the mobile machine via radio link 816,822. Alternatively, raw position data can be transmitted from base station 802 to position station 804 via radio link 816,822, and processed by computer 818.

Machine-mounted receiver 125 receives position information from the satellite constellation, while the kinematic GPS software 820 combines the signal from receiver 125 and the correction factor from base reference 802 to determine the position of receiver 125 relative to base reference 802 and the work site within a few centimeters. This position information is three-dimensional (e.g., latitude, longitude, and elevation; easting, nording, and up; or the like) and is available on a point-by-point basis according to the sampling rate of the GPS system.

Referring to machine and bucket position module 806, once the digitized plans or models of the site have been loaded into logic means 250, the position information received from position module 804 is used by the logic means 250 together with the database 828 to generate a graphic icon of the machine superimposed on the actual site model on operator interface 260 corresponding to the actual position and orientation of the machine on the site.

Because the sampling rate of the position module 804 results in a time/distance delay between position coordinate points as the machine operates, the dynamic database 828 of the present invention uses a differencing algorithm to determine and update in real-time the path of the receiver 125.

With the knowledge of the machine's exact position relative to the site, a digitized view of the site, and the machine's progress relative thereto, the operator can maneuver the bucket to excavate material without having to rely on physical markers placed over the surface of the site. And, as the operator operates the machine within the work site the dynamic database 828 continues to read and manipulate incoming position information from module 804 to dynamically update both the machine's position relative to the site and the position and orientation of the bucket.

The work machine 102 is equipped with a positioning system capable of determining the position of the machine with a high degree of accuracy, in the preferred embodiment a phase differential GPS receiver 125 located on the machine at fixed, known coordinates relative to the car body 104. Machine-mounted receiver 125 receives position signals from a GPS constellation and an error/correction signal from base reference 808 via radio link 816,822 as described in FIG. 7. The system uses both the satellite signals and the error/correction signal from base reference 808 to accurately determine its position in three-dimensional space. Alternatively, raw position data can be transmitted from base reference 802, and processed in known fashion by the machine-mounted receiver system to achieve the same result. Information on kinematic GPS and a system suitable for use with the present invention can be found, for example, in U.S. Pat. No. 4,812,991 dated Mar. 14, 1989 and U.S. Pat. No. 4,963,889 dated Oct. 16, 1990, both to Hatch. Using kinematic GPS or other suitable three-dimensional position signals from an external reference, the location of receiver 125 can be accurately determined on a point-by-point basis within a few centimeters as the work machine 102 operates within the work site. The present sampling rate for coordinate points using the illustrative positioning system is approximately one point per second.

The coordinates of base receiver 808 can be determined in any known fashion, such as GPS positioning or conventional surveying. Steps are also being taken in this and other countries to place GPS references at fixed, nationally surveyed sites such as airports. If the reference station is within range (currently approximately 20 miles) of such a nationally surveyed site and local GPS receiver, that local receiver can be used as a base reference. Optionally, a portable receiver such as 808, having a tripod-mounted GPS receiver, and a rebroadcast transmitter can be used. The portable receiver 808 is surveyed in place at or near the work site.

In the preferred embodiment, the work site has previously been surveyed to provide a detailed topographic design. The creation of geographic or topographic designs of sites such as landfills, mines, and construction sites with optical surveying and other techniques is a well-known art; reference points are plotted on a grid over the site, and then connected or filled in to produce the site contours on the design. The greater the number of reference points taken, the greater the detail of the map.

Systems and software are currently available to produce digitized, three-dimensional maps of a geographic site. For example, a site plan can be converted into three-dimensional digitized models of the original site geography or topography. The site contours can be overlaid with a reference grid of uniform grid elements in known fashion. The digitized site plans can be superimposed, viewed in two or three dimensions from various angles (e.g., profile and plan), and color coded to designate areas in which the site needs to be excavated.

Available software can also make cost estimates and identify various site features and obstacles above or below ground.

Once location and orientation of the work machine within the work site are obtained by the logic means 250, this data can be used by a known automatic excavation system to control excavation with respect to the work site rather than with respect to the work machine itself. An example of an automatic excavation system useful in connection with the present invention is disclosed in U.S. Pat. No. 5,065,326 issued Nov. 12, 1991 to Sahm.

The linkage position sensors illustrated above in FIG. 4 are utilized by the known methods to indicate the location of the bucket with respect to the center of rotation of the excavator. By combining bucket location and orientation in the machine reference frame with the machine location and orientation in an external reference frame, obtained by the algorithm described below, the bucket location and orientation can be offset by using known geometric translations to establish bucket location and orientation within the external reference frame. Thus, the position of the bucket with respect to the work site is monitored and controlled.

Figure 8:
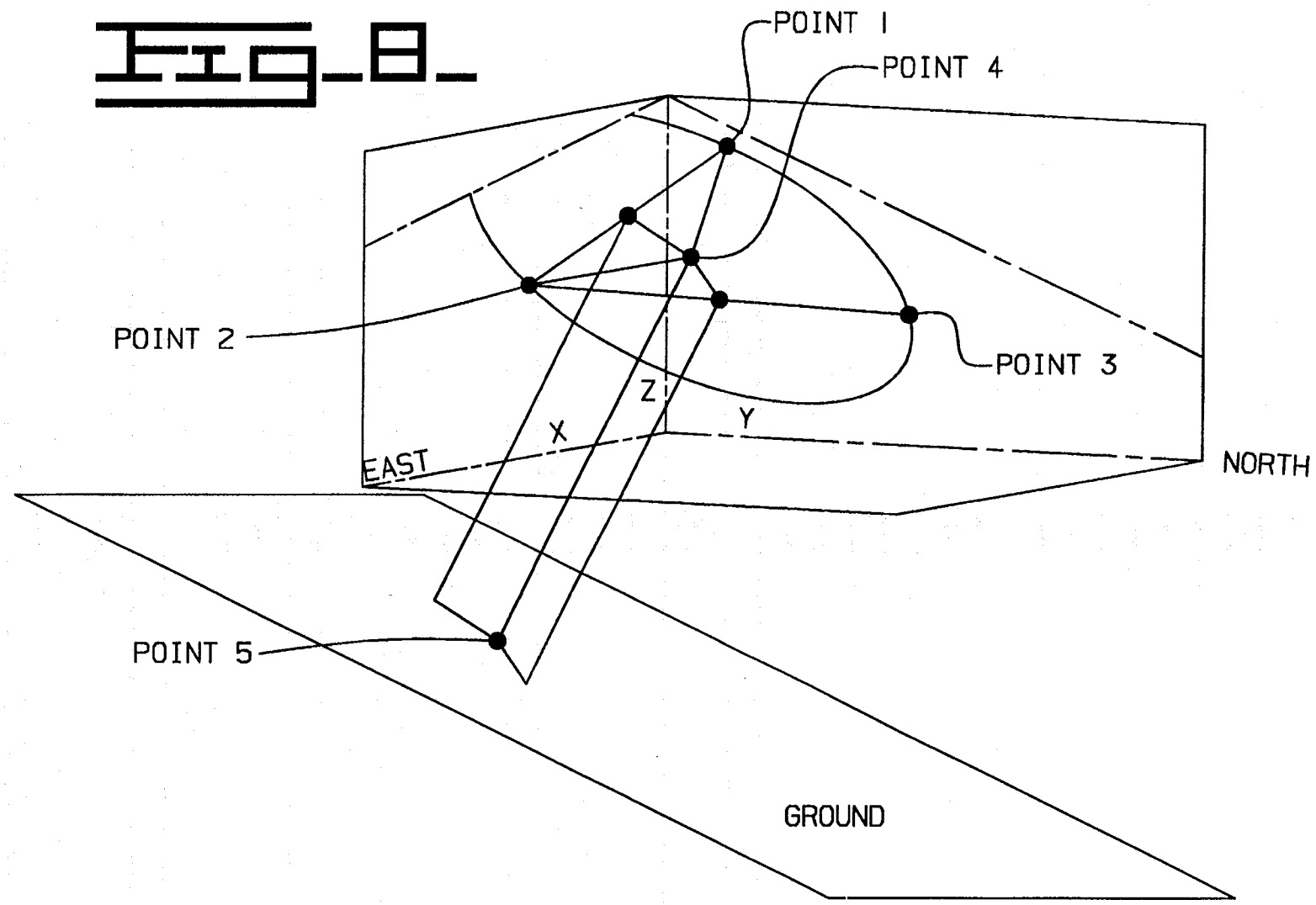
FIG. 8 illustrates the geometry on which portions of the system is based.
Figure 9A:
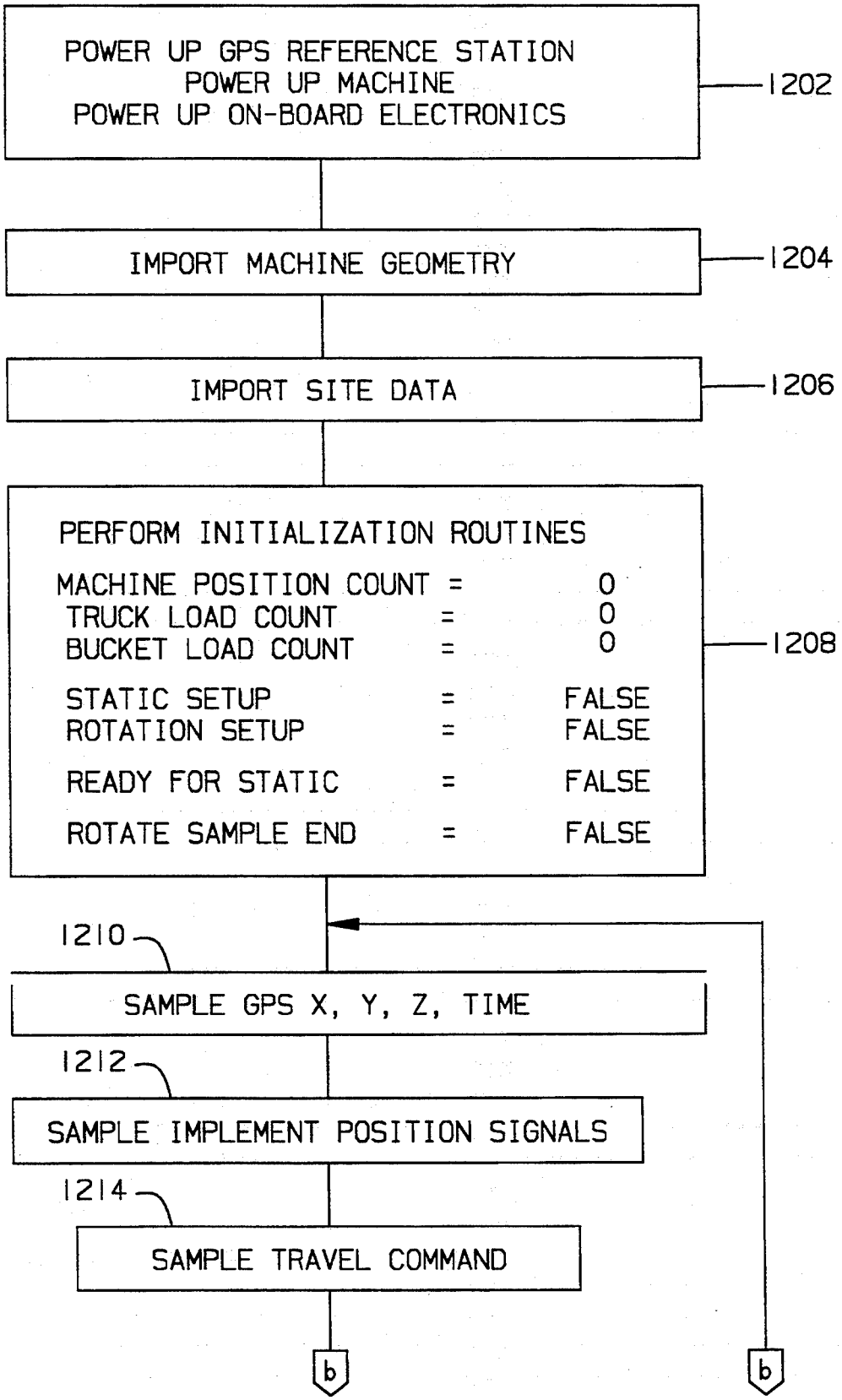
FIGS. 9*a* through 9*e* illustrate a flow chart of an algorithm used in an embodiment of the invention.
Figure 9B:
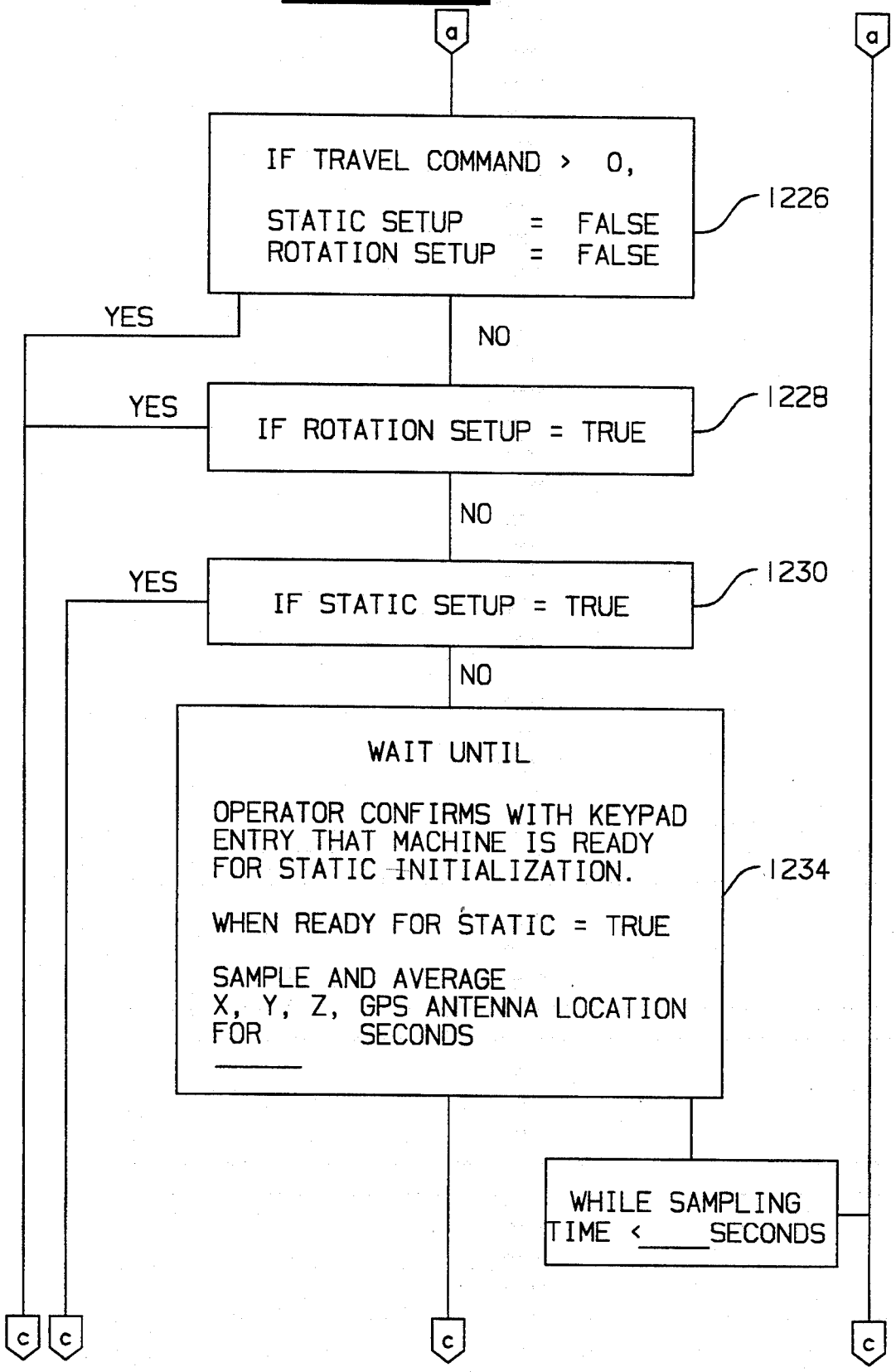
Figure 9C:
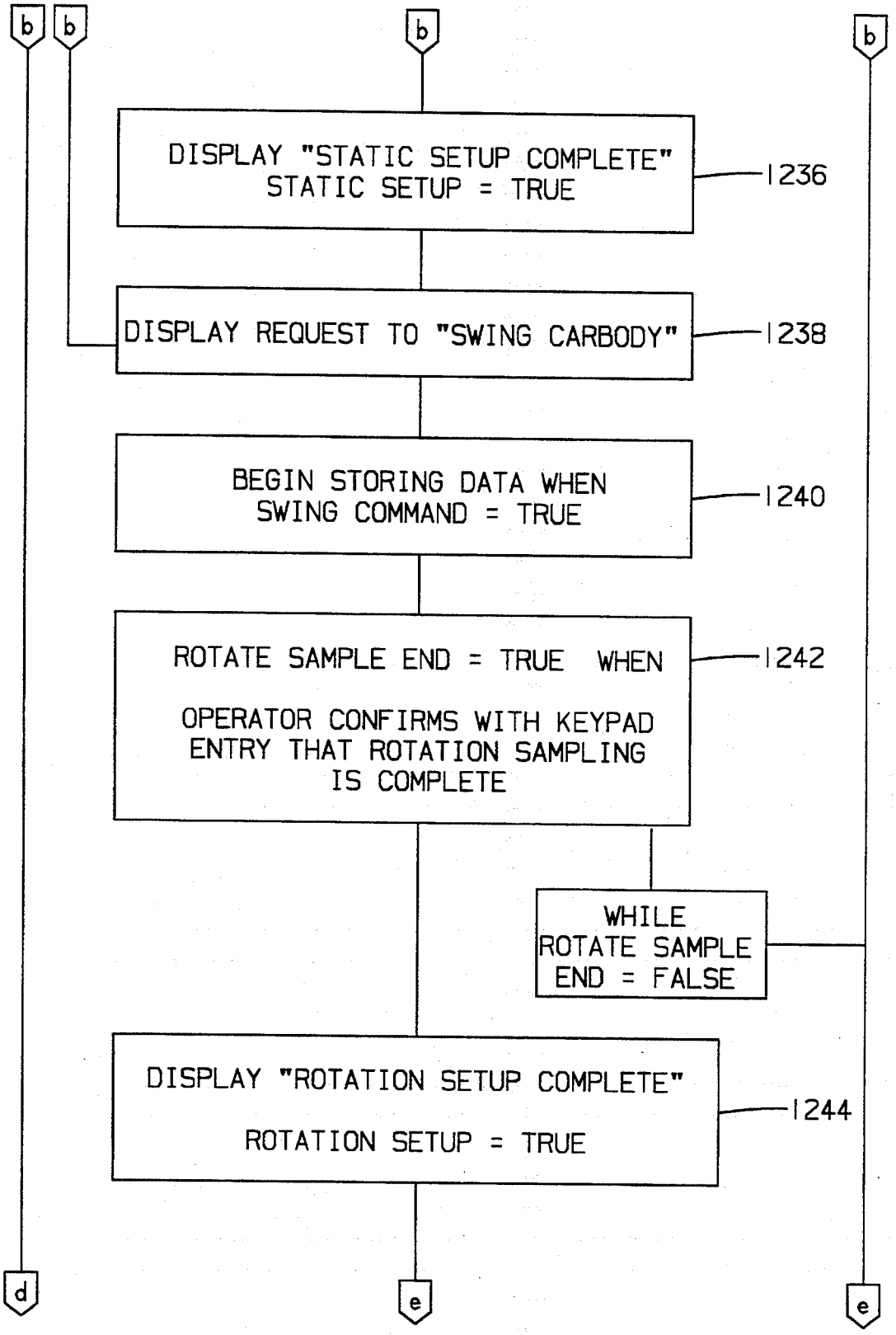
Figure 9D:
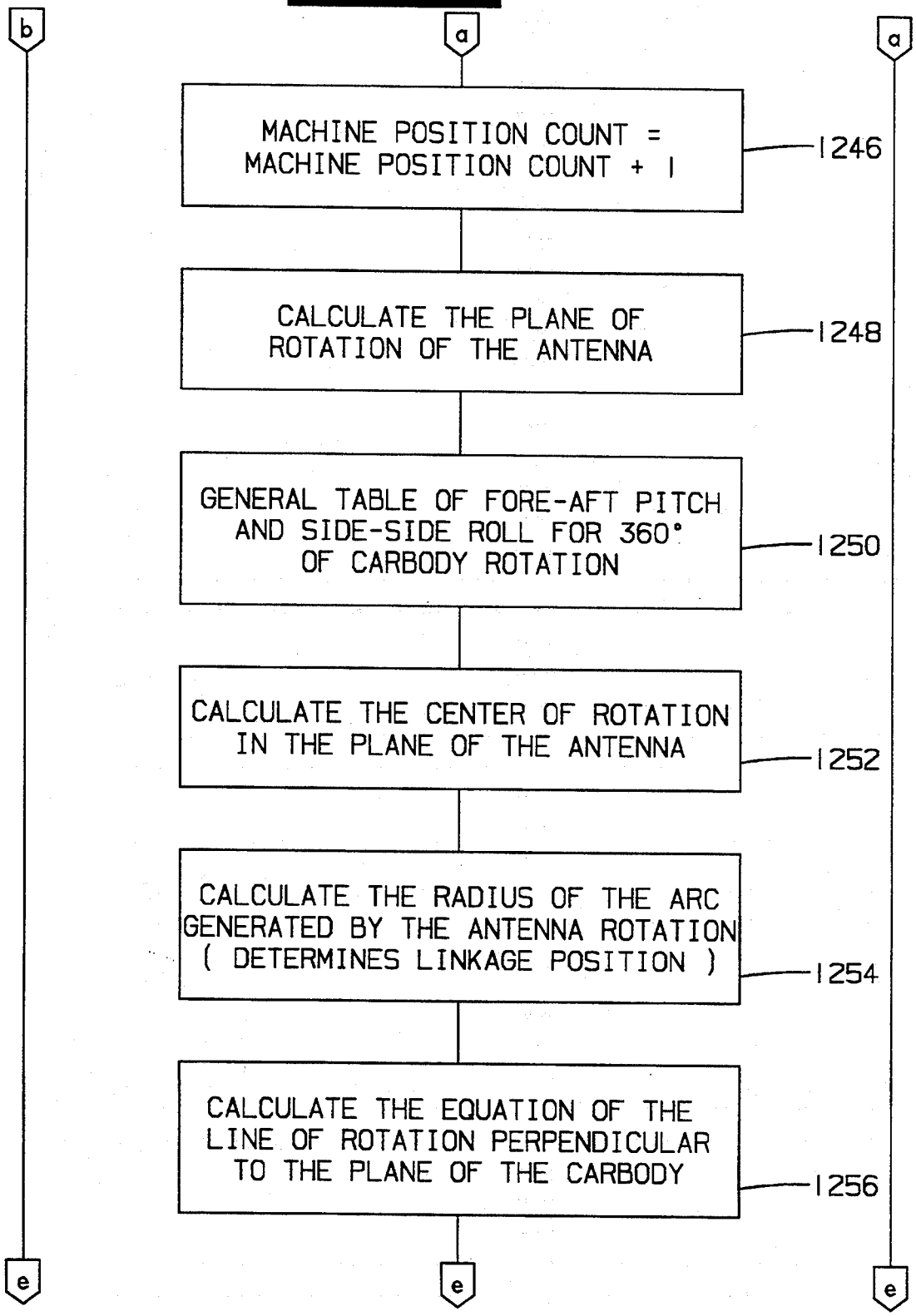
Figure 9E:
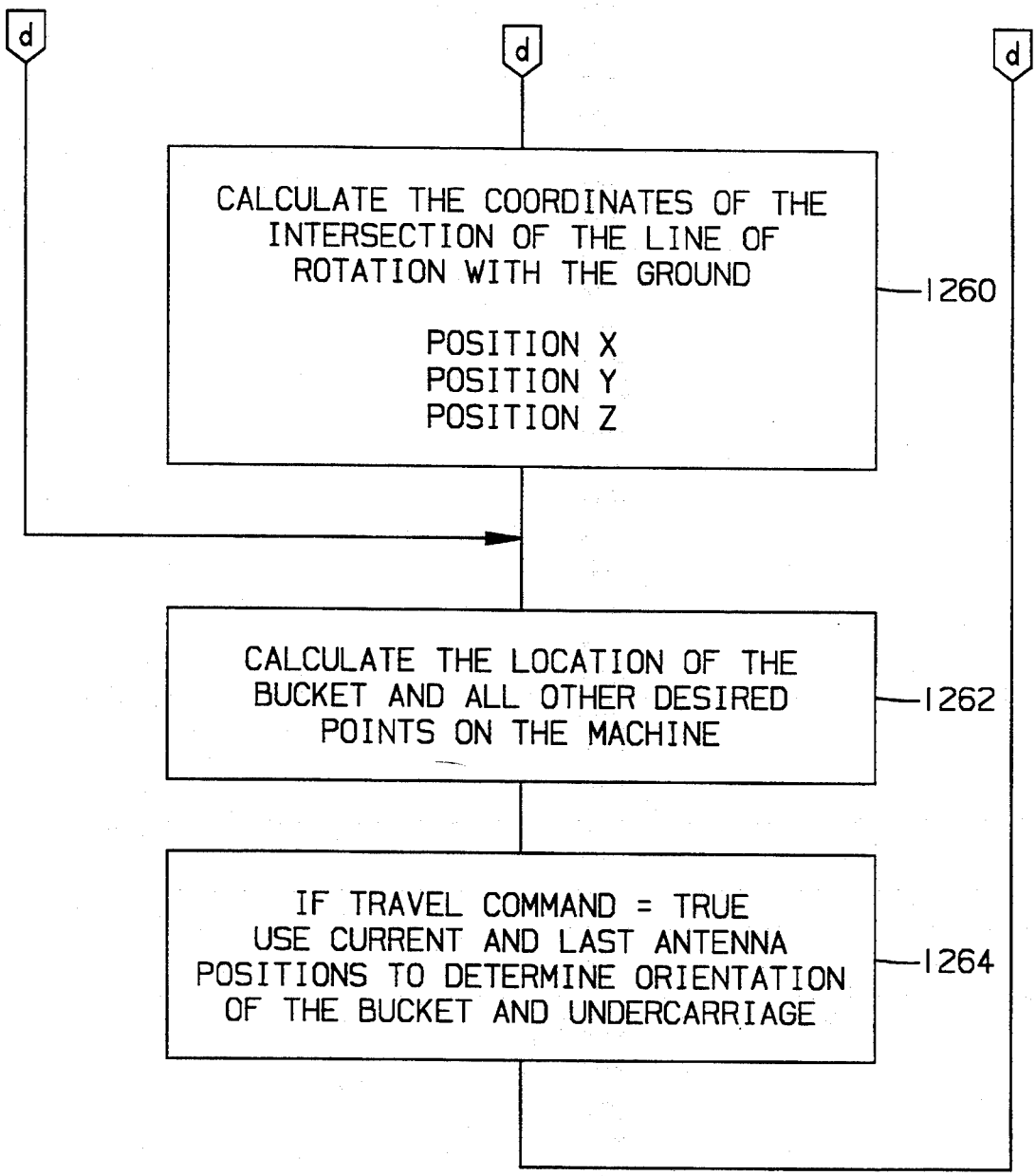

Turning now to the illustration of FIG. 8, the calculation of the location and orientation of the car body 104 and the location of the bucket 120 which is performed by the logic means 250 is described. As described below, roll and pitch of an excavator refers to the side-side and fore-aft slope. Since an excavator rotates, roll and pitch continually varies from the operator's perspective in many operating environments. Therefore, the equation of the plane upon which the car body 104 rotates is calculated, and from this equation, the slope, or roll and pitch, can be displayed using whatever frame of reference is desired. The two most common frames of reference would be to display the surface using perpendicular axes determined by N-S and E-W, or along and transverse to the machines fore-aft axis.

The calculations listed below determine the equation of a plane from the x, y, and z coordinates of 3 points sampled by the receiver 125. For ease of understanding, arbitrary values were selected to provide sample calculations; however, none of the values used should in any way limit the generality of the invention and these formulae.

To calculate the Plane of Rotation Through 3 Sampled Points:

$$pt1 = (pt1x, pt1y, pt1z) \quad (1, 1, 3)\ PNT1$$
$$pt2 = (pt2x, pt2y, pt2z) \quad (7, 2, 2)\ PNT2$$
$$pt3 = (pt3x, pt3y, pt3z) \quad (2, 5, 1)\ PNT3$$
$$pt1x*A + pt1y*B + pt1z*C + D = 0$$
$$Pt2x*A + pt2y*B + pt2z*c + D = 0$$
$$Pt3x*A + pt3y*B + pt3z*c + D = 0$$

By solving the above formulae, the following solution is obtained:

$$-0.02439*pt_-0.013414*pt_y-0.28049*pt_z+1=0$$

For a simple example, assume an operator is facing North (positive y direction in this example). The side-side roll is calculated by picking any two x values on a plane perpendicular to the direction and calculating the z values.

For x=0, y=0, z=3.56519 x=7, y=0, z=2.9565

$$\text{Side-Side roll} = (2.9565 - 3.56519)/(7 - 0) = .08696$$
with West higher than East
$$= 4.96 \text{ degrees}$$

Similarly, the fore-aft pitch can be calculated;

For x=7, y=0, z=3.56519 x=7, y=5, z=1.17402

$$\text{Fore-aft pitch} = (1.17402 - 3.56519)/(5) = .47823$$
with South higher than North
$$= 25.56 \text{ degrees}$$

In the preferred embodiment, the center of rotation of the arc described by the rotation of the antenna and 3 sampled points is determined by locating the intersection of 3 planes. One plane is determined by the rotation of the antenna. A second plane is perpendicular to and extending through the midpoint of a line connecting pt 1 and pt 2. A third plane is perpendicular to and extending through the midpoint of a line connecting pt 2 to pt 3. Sample calculations to determine the center of rotation of the receiver rotation are listed below.

Calculate the Plane Perpendicular to Line From ptl and pt2 Through the Midpoint $$pt1 = (pt1x, pt1y, pt1z) \quad (1, 1, 3)$$
$$pt2 = (pt2x, pt2y, pt2z) \quad (7, 2, 2)$$

midpt_1_2=((pt1x+pt2x)/2, (pt1y+pt2y)/2, (pt1z+pt2z)/2)

midpt_1_2=(4,1.5,2.5)

dir_num_x=pt2x−pt1x=6 dir_num_y=pt2y−pt1y=1 dir_num_z=pt2z−pt1z=−1 where dir_num_x, dir_num_y, and dir_num_z refer to the direction number in x, y, and z, respectively.

0=dir_num_x* (X-midpt_1_2_x)+dir_num_y* (Y-midpt_1_2_y)+dir_num_z* (Z-midpt_1_2_z)

where midpt_1_2_x, midpt_1_2_y, and midpt_1_2_z refer to the x, y, and z coordinates, respectively, of the midpoint of the line connecting ptl and pt2.

Solving for the equation of the plane provides:

$$0=6pt_x+pt_y-pt_z-23$$

Similarly, calculate the Plane Perpendicular to Line From pt2 and pt3 Through the Midpoint.

$$pt2 = (pt2x, pt2y, pt2z) \quad (7, 2, 2)$$
$$pt3 = (pt3x, pt3y, pt3z) \quad (2, 5, 1)$$

midpt_2_3=((pt2x+pt3x)/2, (pt2y+pt3y)/2, (pt2z+pt3z)/2)

midpt_2_3=(4.5,3.5,1.5)

dir_num_x=pt3x−pt2x=−5 dir_num_y=pt3y−pt2y=3 dir_num_z=pt3z−pt2z=−1

0=dir_num_x* (X-midpt_2_3 x)+dir_num_y* (Y-midpt_2_3 y)+dir_num_z*(Z-midpt_2_3 z)

$$0=-5pt_x+3pty_-pt_z+13.5$$

Calculate Point of Intersection Between Plane of Rotation, Plane Perpendicular to Midpoint Pt1_2, and Plane Perpendicular to Midpoint Pt2_3

$$-.02439*pt_x - .13414*pt_y - .28049*pt_z + 1 = 0$$
= Plane of Rotation $$6pt_x + pt_y - pt_z - 23 = 0$$
= Plane Perp to Midpt $Pt1_2$ $$-5pt_x + 3pt_y - pt_z + 13.5 = 0$$
= Plane Perp to Midpt $Pt2_3$ $$23pt_y - 11pt_z - 34 = 0$$
= Intersection of the 2 Planes through Midpoints To calculate the point of the center of rotation of the receiver:

$$-.02439*pt_x - .13414*pt_y - .28049*pt_z + 1 = 0$$
$$6pt_x + pt_y - pt_z - 23 = 0$$
$$pt_y = -2.1876pt_z + 6.96909$$

$$pt_z_ant_rot_center = 2.05968$$
$$pt_y_ant_rot_center = (11\,pt_z + 34)/23 = 2.46333$$
$$pt_x_ant_rot_center = (-pt_y + pt_z + 23)/6 = 3.76606$$

Since the receiver 125 is fixed with respect to the car body 104, its radius of rotation and height above the ground are known. The intersection of the line of carbody rotation and the ground can be calculated as shown below. This point is important because the z coordinate indicates the elevation of the ground directly beneath the machine.

The equation of a line perpendicular to the plane through the center of antenna rotation as derived above is:

$$-0.02439*pt_x - 0.13414*pt_y$$
$$0.28049*pt_z + 1 = 0$$

pt_x_ant_rot_center=3.76606
pt_y_ant_rot_center=2.46333
pt_z_ant_rot_center=2.05968
pt_x_qnd_rot_center=3.76606−0.02439t
pt_y_gnd_rot_center=2.46333−0.13414t
pt_z_gnd_rot_center=2.05968−0.28049t
assume height=5=((−0.02439t) 2+(0. 13414t) 2+(0.28049t) 2) 0.5
5=0.31187t; t=16.03231

$$pt_x_gnd_rot_center = 3.76606 - .02439t = 3.37503$$
$$pt_y_gnd_rot_center = 2.46333 - .13414t = .31276$$
$$pt_z_gnd_rot_center = 2.05968 - .28049t = 2.43722$$

Where pt_x_gnd_rot_center, pt_y_gnd_rot_center, and pt_z_gnd_rot_center are the coordinates in x, y, and z, respectively, of the intersection of the axis of rotation with the ground.

Now, enough information is known to display the work machine relative to the surroundings. With a known location and orientation of the work machine in the external reference frame, the location of the bucket in the external reference frame is obtained by using known geometric translations between the external reference frame and the location of the bucket in the machine reference frame, obtained from the sensor signals described in connection with FIG. 4.

A flow chart of an algorithm to be executed by the logic means 250 in one embodiment of the invention is illustrated in FIGS. 9a–9e. The GPS reference station 802, the work machine 102, and the on-board electronics are powered up at block 1202. The machine geometry and site data are uploaded to the logic means 250 from the data base 828 in blocks 1204 and 1206, respectively. The variables and flags listed in block 1208 are initialized. The GPS position of the receiver 125 is sampled and time stamped at block 1210.

The implement control signals are sampled at block 1212. The travel command is sampled at block 1214 by determining whether the control lever 255 associated with travel has been actuated. If travel command is "true" at block 1226 thus indicating that the undercarriage is moving, then the static_setup and rotation_setup flags are set equal to "false" and control passes to block 1262. Similarly if rotation_setup is true at block 1228 thus indicating that the rotation setup at that location has been completed, control passes to block 1262. If static_setup is true at block 1230 thus indicating that the static_setup has been completed, then control passes to block 1238.

The operator then uses a keypad included in the operator interface to indicate that the machine is ready_for_static initialization. When the readyforstatic flag is therefore set equal to "true", the receiver 125 location is sampled and averaged for a predetermined length of time. The phrase "static setup complete" is then displayed on the operator interface 260 and the static_setup flag is set equal to "true" at block 1236.

It should be noted that the static setup routine described in connection with blocks 1230, 1234, and 1236 is included for generality only and represents only one embodiment. The algorithm of FIG. 9 is operable without static setup in which case the first point would be automatically sampled in response to the travel command being substantially equal to zero at block 1226 and the algorithm would proceed to block 1238 to begin rotation setup.

At block 1238, the operator interface 260 displays the message "swing car body". When swing_command is "true" in response to the swing sensor 243 indicating that the car body is swinging, receiver locations derived by the kinematic GPS system are stored at regular intervals until the operator indicates via the keypad that rotation sampling is complete at block 1242. However, the operator is prevented from terminating rotation setup until three points have been obtained. The operator interface 260 then indicates that "rotation setup is complete" and the rotation_setup flag is set equal to "true". The machine_position_count is incremented at block 1246.

The plane of rotation of the receiver 125 is calculated in block 1248 as described above in connection with FIG. 8. The logic means 250 then calculates at block 1250 the fore-aft pitch and sideside roll of the car body for each of the 360 degrees of rotation to save processing time during operation of the mining shovel. More precision of course can be achieved by increasing the number of calculations.

At block 1252, the center of rotation of the plane of receiver rotation is calculated as described above in connection with FIG. 10. The equation of the line of rotation perpendicular to the plane of the car body 106 is calculated at block 1256. The coordinates of the intersection of the line of rotation with the ground is determined at block 1260. At block 1262, the location of the bucket 108 is determined in response to the location of the receiver 125, the above calculated values, and the signals from the sensors shown in FIG. 4.

If travel command is true at block 1264, then the current and last receiver positions are used to calculate the location of the work machine 102. In the preferred embodiment, it is assumed that travel occurs only when front of the car body 104 is facing in the direction of undercarriage travel. This assumption allows ease of tracking of the machine during travel.

Alternatively, the position of the work machine is only calculated, and the machine displayed in the work site, in response to the sampled points fitting the definition of a circle. This will generally only occur when the undercarriage is stationary.

Industrial Applicability

In operation the present invention provides a simple system for determining the location and orientation of the work machine 102. A kinematic GPS system is mounted on the work machine 102 such that it is away from the center of rotation by a measurable amount. As the car body rotates from side to side, the receiver 125 traces an arc. This arc is in either a single plane (x) or is tilted through some angle and also tipped through some angle. By computing the trace in x,y,z, the tilt and tip angle of the excavator platform is calculated. Combining the obtainable parameters the location of the machine in x,y, and z and the roll and pitch of the machine at that location are calculated.

The illustrated embodiments provide an understanding of the broad principles of the invention, and disclose in detail a preferred application, and are not intended to be limiting. Many other modifications or applications of the invention can be made and still lie within the scope of the appended claims.

Other aspects, objects, and advantages of this invention can be obtained from a study of the drawings, the disclosure, and the appended claims.

We claim:

1. An apparatus for determining the location of a digging implement at a work site, comprising:

an undercarriage;

a car body rotatably connected to said undercarriage;

a receiver connected to said car body;

positioning system means for determining the location of said receiver in three dimensional space;

means for rotating said car body whereby said receiver moves through an arc, said positioning system means determining the location of said receiver at a plurality of points along said arc; and a processing means for determining the location of said car body in response to the location of said plurality of points.

2. The apparatus, as set forth in claim 1, wherein said processing means determines a plane of rotation of said receiver.

3. The apparatus, as set forth in claim 2, wherein said processing means calculates a center of rotation of said receiver.

4. The apparatus, as set forth in claim 1, wherein said processing means determines the location of an intersection of an axis of rotation of said receiver with the ground.

5. The apparatus, as set forth in claim 1, wherein said processing means calculates a table of fore-aft pitch and side-side roll for a complete car body rotation.

6. The apparatus for determining the location of a digging implement at a work site, comprising:

an undercarriage;

a car body rotatably connected to said undercarriage;

an implement linkage connected to said car body;

one or more sensor means for producing linkage signals indicative of the configuration of said implement linkage, said implement linkage including a digging implement;

a receiver connected to said car body;

a positioning means for determining the location of said receiver in three dimensional space;

means for rotating said car body whereby said receiver moves through an arc, said positioning means determining the location of said receiver at a plurality of points along said arc; and a processing means for determining the location of said digging implement in response three or more of said plurality of points and said linkage signals.

7. The apparatus, as set forth in claim 6, wherein said processing means determines the location of an intersection of an axis of rotation of said receiver with the ground.

8. The apparatus, as set forth in claim 6, wherein said processing means calculates a table of fore-aft pitch and side-side roll for a complete car body rotation.

9. A method for determining the location of a work machine at a work site, the work machine including an undercarriage and a car body rotatably connected to the undercarriage, comprising the steps of:

rotating the car body;

receiving signals from an external reference source;

determining the location of a receiver in three dimensional space as said car body rotates whereby the location of the receiver is determined at a plurality of points along an arc; and determining the location of said car body in response to the location of three or more of said plurality of points.

10. The method, as set forth in claim 9, including the step of determining a plane of rotation of said receiver.

11. The method, as set forth in claim 10, including the step of calculating a center of rotation of said receiver.

12. The method, as set forth in claim 9, including the step of determining the location of an intersection of an axis of rotation of said receiver with the ground.

13. The method, as set forth in claim 9, including the step of calculating a table of fore-aft pitch and side-side roll for a complete car body rotation.

14. The method, as set forth in claim 9, wherein the work machine includes an implement linkage connected to said car body and a bucket connected to the implement linkage and including the steps of:

producing linkage signals indicative of the configuration of the implement linkage; and determining the location of the bucket in response to said linkage signals and the location of said plurality of points.

15. An apparatus for determining the location of a digging implement at a work site, comprising:

an undercarriage;

a car body rotatably connected to said undercarriage;

a receiver connected to said car body;

positioning system means for determining the location of said receiver in three dimensional space;

means for rotating said car body whereby said receiver moves through an arc, said positioning system means determining the location of said receiver at a plurality of points along said arc; and a processing means for determining the orientation of said car body in response to the location of three or more of said plurality of points.

16. The apparatus, as set forth in claim 15, wherein said processing means determines the location of said car body in response to the location of three or more of said plurality of points.

17. A method for determining the location of a work machine at a work site, the work machine including an undercarriage and a car body rotatably connected to the undercarriage, comprising the steps of:

rotating the car body;

receiving signals from an external reference source;

determining the location of a receiver in three dimensional space as said car body rotates whereby the location of the receiver is determined at a plurality of points along an arc; and determining the orientation of said car body in response to the location of three or more of said plurality of points.

18. The method, as set forth in claim 17, including the step of determining the location of said car body in response to the location of three or more of said plurality of points.

* * * * *